US011377891B2

(12) United States Patent
Salice

(10) Patent No.: US 11,377,891 B2
(45) Date of Patent: Jul. 5, 2022

(54) DAMPED HINGE FOR PIECES OF FURNITURE

(71) Applicant: ARTURO SALICE S.P.A., Novedrate (IT)

(72) Inventor: Sergio Salice, Carimate (IT)

(73) Assignee: ARTURO SALICE S.P.A., Novedrate (IT)

( * ) Notice: Subject to any disclaimer, the term of this patent is extended or adjusted under 35 U.S.C. 154(b) by 0 days.

(21) Appl. No.: 17/050,950

(22) PCT Filed: Apr. 1, 2019

(86) PCT No.: PCT/EP2019/058195
§ 371 (c)(1),
(2) Date: Oct. 27, 2020

(87) PCT Pub. No.: WO2019/206578
PCT Pub. Date: Oct. 31, 2019

(65) Prior Publication Data

US 2021/0230922 A1 Jul. 29, 2021

(30) Foreign Application Priority Data

Apr. 27, 2018 (IT) ..... 102018000004919

(51) Int. Cl.
*E05F 1/08* (2006.01)
*E05F 5/00* (2017.01)
(Continued)

(52) U.S. Cl.
CPC ..... *E05F 5/006* (2013.01); *E05D 3/16* (2013.01); *E05D 11/1021* (2013.01);
(Continued)

(58) Field of Classification Search
CPC ..... E05Y 2900/20; E05Y 2900/202; E05Y 2900/204; E05Y 2900/208; E05Y 2201/25;
(Continued)

(56) References Cited

U.S. PATENT DOCUMENTS 1,048,168 A * 12/1912 Hubbell ..... H01H 19/62 200/469
5,058,238 A * 10/1991 Lautenschlager ..... E05D 3/16 16/278
(Continued)

FOREIGN PATENT DOCUMENTS

CN 101 806 182 A 8/2010
CN 103 726 730 B 5/2016
(Continued)

OTHER PUBLICATIONS

International Search Report dated Jun. 7, 2019 received in International Application No. PCT/EP2019/058195.
(Continued)

*Primary Examiner* — Chuck Y Mah
(74) *Attorney, Agent, or Firm* — Scully, Scott, Murphy & Presser, P.C.

(57) ABSTRACT

A hinge for mounting a door on a piece of furniture or the like comprises a hinge arm, a box connected to the hinge arm by an articulation system comprising a plurality of movable connecting levers and seven articulation axes, spring means acting in closing direction of the hinge, and a damping device having an actuation member linearly movable according to a longitudinal axis; the damping device is at least partially enclosed between the side walls of the hinge arm, and the actuation member of the damping device extends at a front end of the hinge arm facing the hinge box for contacting thrust element of one of the connecting levers of the articulation system or integral with one of the con-
(Continued)

necting levers or with the hinge box at least in a range near the closing position of the hinge.

12 Claims, 6 Drawing Sheets

(51) Int. Cl.
*E05D 3/16* (2006.01)
*E05D 11/10* (2006.01)

(52) U.S. Cl.
CPC ..... *E05Y 2201/25* (2013.01); *E05Y 2201/264* (2013.01); *E05Y 2201/626* (2013.01); *E05Y 2600/53* (2013.01); *E05Y 2900/20* (2013.01)

(58) Field of Classification Search
CPC ..... E05Y 2201/26; E05Y 2201/626; E05Y 2201/20; E05Y 2201/21; E05Y 2201/261; E05Y 2600/53; E05F 5/006; E05F 5/02; E05F 5/027; E05D 11/1021; E05D 11/1042; E05D 11/105; E05D 11/1064; E05D 7/04; E05D 7/0407; E05D 7/125; E05D 3/16; E05D 3/142; Y10T 16/5383; Y10T 16/304; Y10T 16/54029
See application file for complete search history.

(56) References Cited

U.S. PATENT DOCUMENTS 6,591,454 B2 * 7/2003 Brustle ..... E05F 5/006 16/374
7,096,535 B2 * 8/2006 Lin ..... E05D 11/1021 16/286
7,340,799 B2 * 3/2008 Salice ..... E05F 5/02 16/84
7,406,749 B2 * 8/2008 Herper ..... E05F 5/006 16/286
8,601,644 B1 * 12/2013 Chen ..... E05F 5/006 16/286
9,777,525 B2 * 10/2017 Salice ..... E05F 3/10
11,041,336 B2 * 6/2021 Weber ..... E05F 5/02
2005/0248246 A1 * 11/2005 Ger ..... E05F 5/006 312/334.47
2007/0251058 A1 * 11/2007 Fitz ..... E05D 3/16 16/287
2011/0072617 A1 * 3/2011 Lin ..... E05F 5/006 16/298
2011/0154609 A1 * 6/2011 Liao ..... E05D 3/142 16/54
2013/0019713 A1 * 1/2013 Krudener ..... E05D 11/00 74/99 R
2013/0239363 A1 * 9/2013 Apur ..... E05F 5/006 16/50
2015/0218863 A1 * 8/2015 Cooper ..... E05D 11/1021
2015/0361709 A1 * 12/2015 Stuke ..... E05F 5/006
2017/0138106 A1 * 5/2017 Stuke ..... E05D 11/1021
2020/0149335 A1 * 5/2020 Stuke ..... E05F 5/006

FOREIGN PATENT DOCUMENTS

CN 106 761 095 A 5/2017
CN 105358783 B 10/2017
KR 100869160 B1 * 11/2008
WO 2005/108726 A1 11/2005
WO WO-2007099101 A1 * 9/2007 ..... E05F 5/006
WO WO-2012136045 A1 * 10/2012 ..... E05F 5/02
WO 2015/039922 A1 3/2015

OTHER PUBLICATIONS

Talian Search Report and Written Opinion dated Nov. 29, 2018 received in Italian Application No. IT2018000004919, together with a partial English-language translation.
Chinese Office Action dated Nov. 24, 2021 received in Chinese Application No. 201980028424.X.

* cited by examiner

DAMPED HINGE FOR PIECES OF FURNITURE

CROSS-REFERENCE TO RELATED APPLICATIONS

This Application is a 35 U.S.C. § 371 application of PCT/EP2019/058195 filed Apr. 1, 2019, which claims priority to Application IT 102018000004919 filed on Apr. 27, 2018.

BACKGROUND OF THE DISCLOSURE

The invention relates to a damped hinge for doors of pieces of furniture or the like, in particular to a hinge provided with a damping device in order to dampen the closing movement of said hinge.

In the furniture sector, pieces of furniture are provided which are equipped with doors supported so that they can swing by means of hinges which comprise a fixed part, which can be connected to the body of the piece of furniture, and a movable part, constituted by a box, which can be connected to the door, such parts being mutually articulated so as to oscillate, for example by means of an articulation system which comprises a plurality of connecting levers.

The hinges further comprise spring means, for example leaf or wire springs, in order to actuate the hinge in the closing direction.

Due to the presence of the spring means, the door, at the closing position, strikes the body of the piece of furniture, causing unwanted noise.

In order to overcome this problem, it has been variously proposed to adopt damping devices, for example associated with one of the parts of the hinge, in order to cushion the closing motion of the hinge, and such devices can be of the linear or rotary type and can use a fluid or grease as a breaking medium.

In particular, in the case of hinges with an articulation system which comprises two connecting rockers and four articulation axes, it is known, for example from EP 1199433, to apply a damping device of the fluid-operated linear type on a wall of the fixed part of the hinge, the device having an actuation member which is shaped and arranged so as to be actuated by the door or by the movable part of the hinge that is fixed to the door.

This solution is simple but is not suitable for example for hinges with an articulation system provided with four connecting levers and seven articulation axes, since due to the configuration of said articulation system it would not be possible to place the damping device at the same time on a wall of the fixed part of the hinge and actuated by the door or by the movable part of the hinge fixed to said door.

For this type of hinge it is instead known, for example from WO 2006/053364, to apply a damping device to one of the connecting levers so that the actuation member can be pressed by a second connecting lever which is adjacent to the preceding one; however, such a solution entails a considerable space occupation of the damping device inside the piece of furniture and greater constructive complexity of the articulation system, and cannot be applied to all types of hinges with seven articulation axes.

As an alternative, it has been proposed to apply a damping device to the movable part of the hinge so that it is actuated by a lever of the articulation system; however, the presence of the damping device inside the door constitutes a hindrance and an obstacle in the normal use of the piece of furniture and therefore is not desirable.

There is therefore the need to have a hinge of the type with four connecting levers and seven articulation axes which is provided with a damping device that is capable of overcoming the drawbacks mentioned above, with particular reference to constructive simplicity and space occupation.

BRIEF SUMMARY OF THE DISCLOSURE

The aim of the present invention is therefore to provide a hinge of the type with four connecting levers and seven articulation axes for doors of pieces of furniture or the like provided with a damping device of the linear type which has a simple actuation and entails limited modifications to the standard configuration of the hinges for the purpose of positioning said damping device.

Within this aim, an object is to provide a hinge for doors of pieces of furniture or the like provided with a damping device of the linear type of the kind mentioned above, which has a limited space occupation inside the piece of furniture and does not entail hindrances to use caused by the presence of additional members on the door.

Another object of the present invention is to provide a hinge for doors of pieces of furniture or the like that is highly reliable, relatively simple to provide and at competitive costs.

This aim, as well as these and other objects which will become better apparently hereinafter, are achieved by a hinge for mounting a door on a piece of furniture or the like, comprising:

a hinge arm having a first and a second side walls, the arm being fixable to a fixed part or to a door of the piece of furniture;

a box fixable to the door or to the fixed part of the piece of furniture and connected to the hinge arm by an articulation system comprising a plurality of movable connecting levers and seven articulation axes;

spring means acting in closing direction of the hinge; and a damping device having an actuation member linearly movable according to a longitudinal axis, characterized in that said damping device is at least partially enclosed between said side walls of the hinge arm, and in that the actuation member of said damping device extends at a front end of the hinge arm facing the hinge box for contacting a thrust element of one of said connecting levers of the articulation system or integral with one of the same levers or with said hinge box at least in a range near the closing position of the hinge.

Further characteristics and advantages of the present invention are furthermore defined in the dependent claims.

BRIEF DESCRIPTION OF THE SEVERAL VIEWS OF THE DRAWINGS

The characteristics and advantages of the present invention will become better apparent from the description that follows of some preferred but non-limiting embodiments of the hinge with damping device for pieces of furniture, with reference to the accompanying figures, wherein.

DETAILED DESCRIPTION OF THE DISCLOSURE

Figure 1:
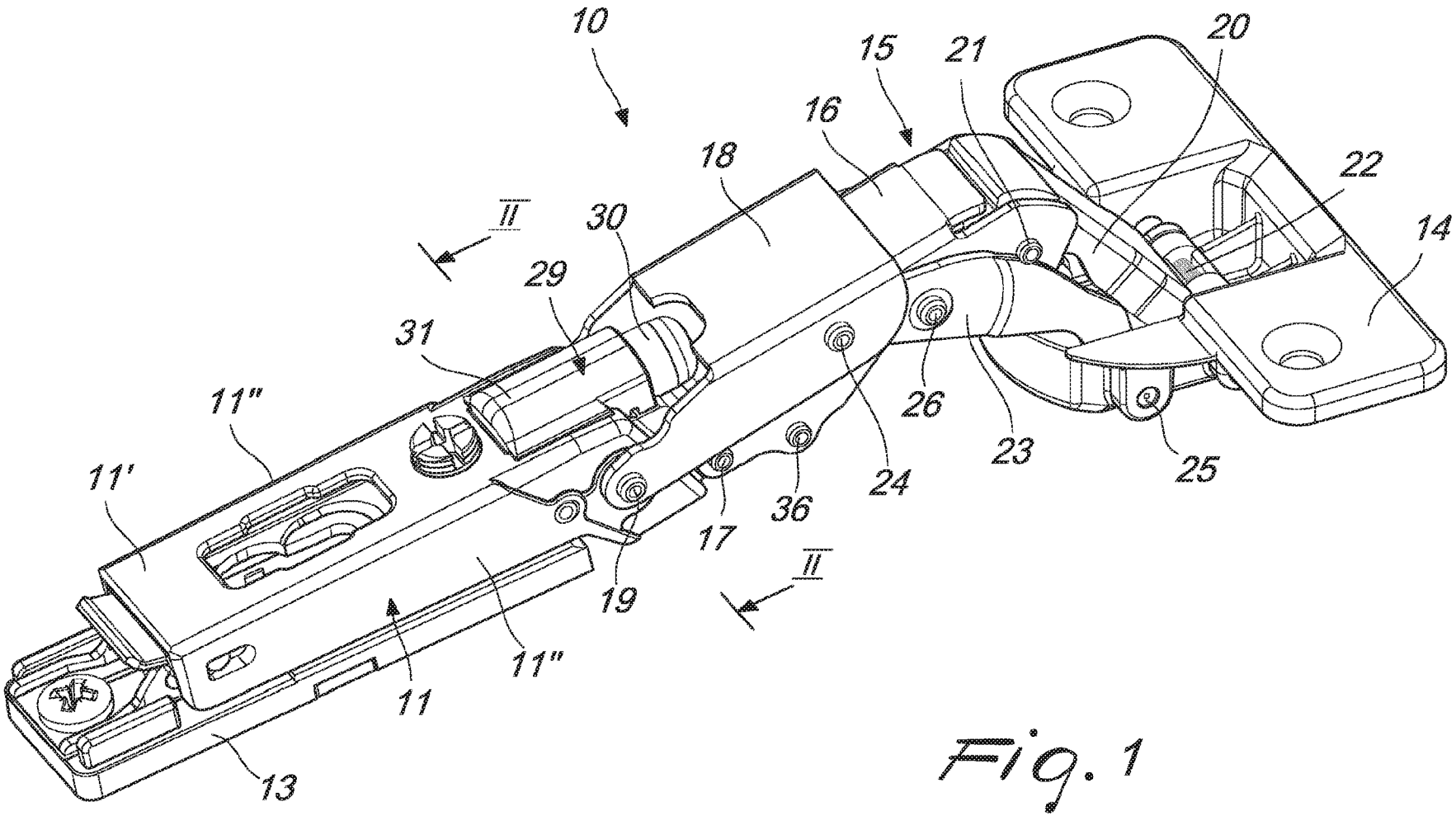
FIG. 1 is a perspective view of the hinge according to a first embodiment of the invention with the damping device applied in a cavity of the hinge arm.
Figure 2:
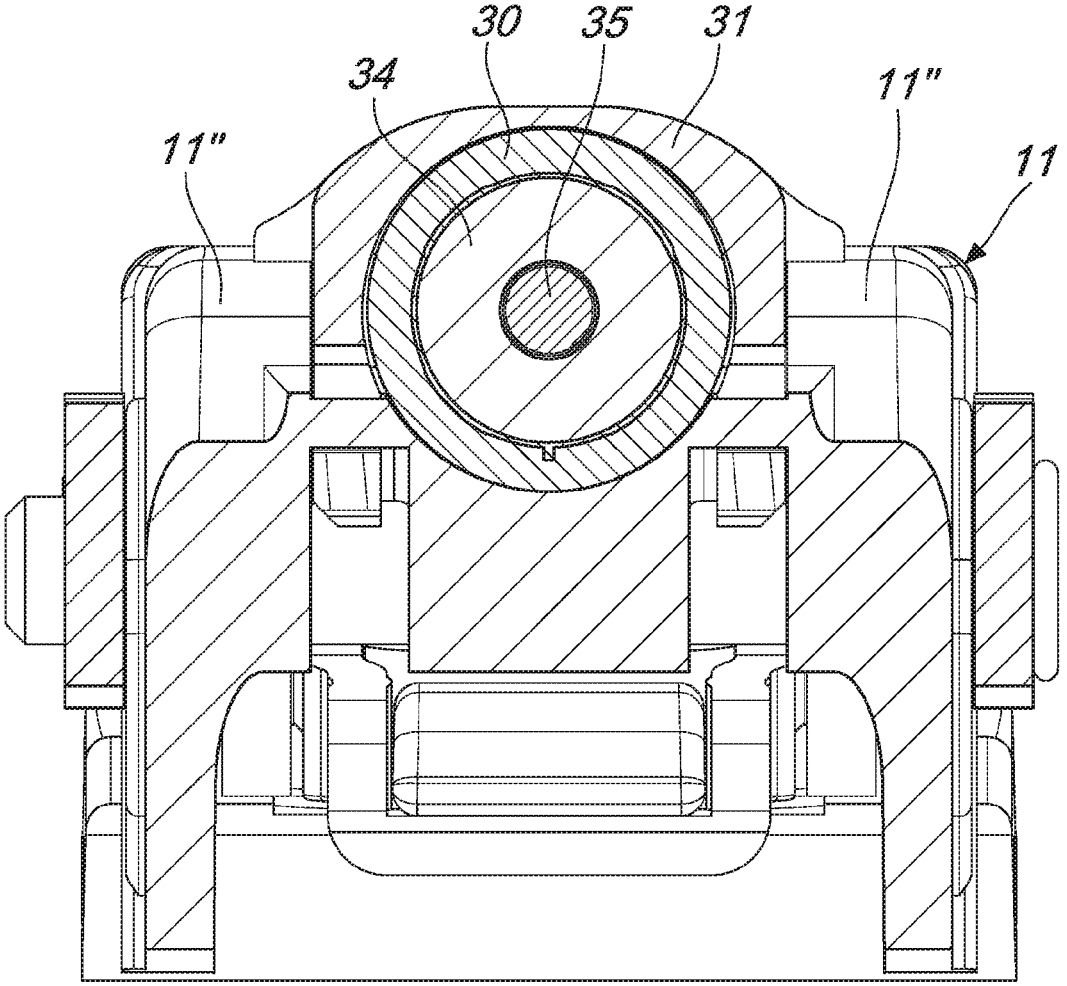
FIG. 2 is a transverse sectional view of the hinge of FIG. 1, taken along the plane 2-2.
Figure 3:
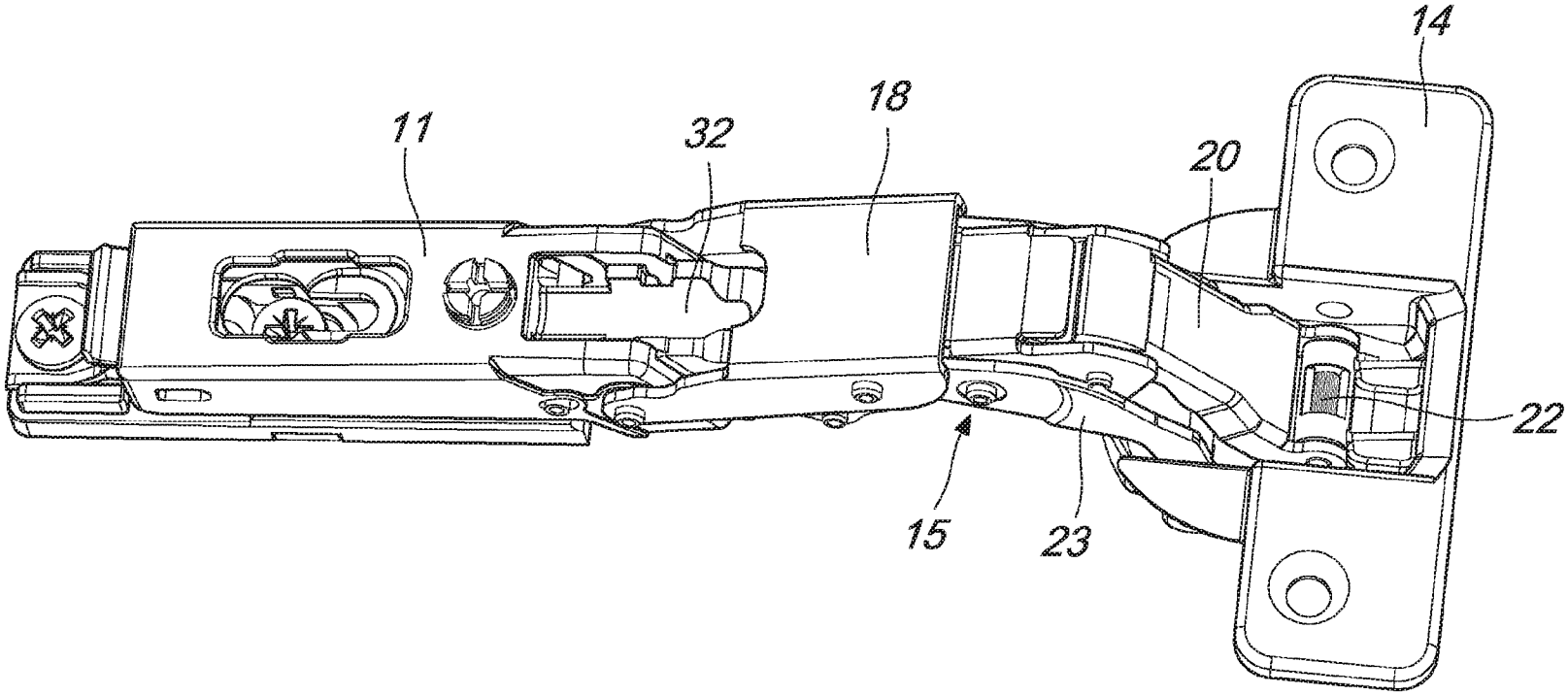
FIG. 3 is an enlarged-scale view of a detail of FIG. 1, with the damping device removed from the arm of the hinge.
Figure 4:
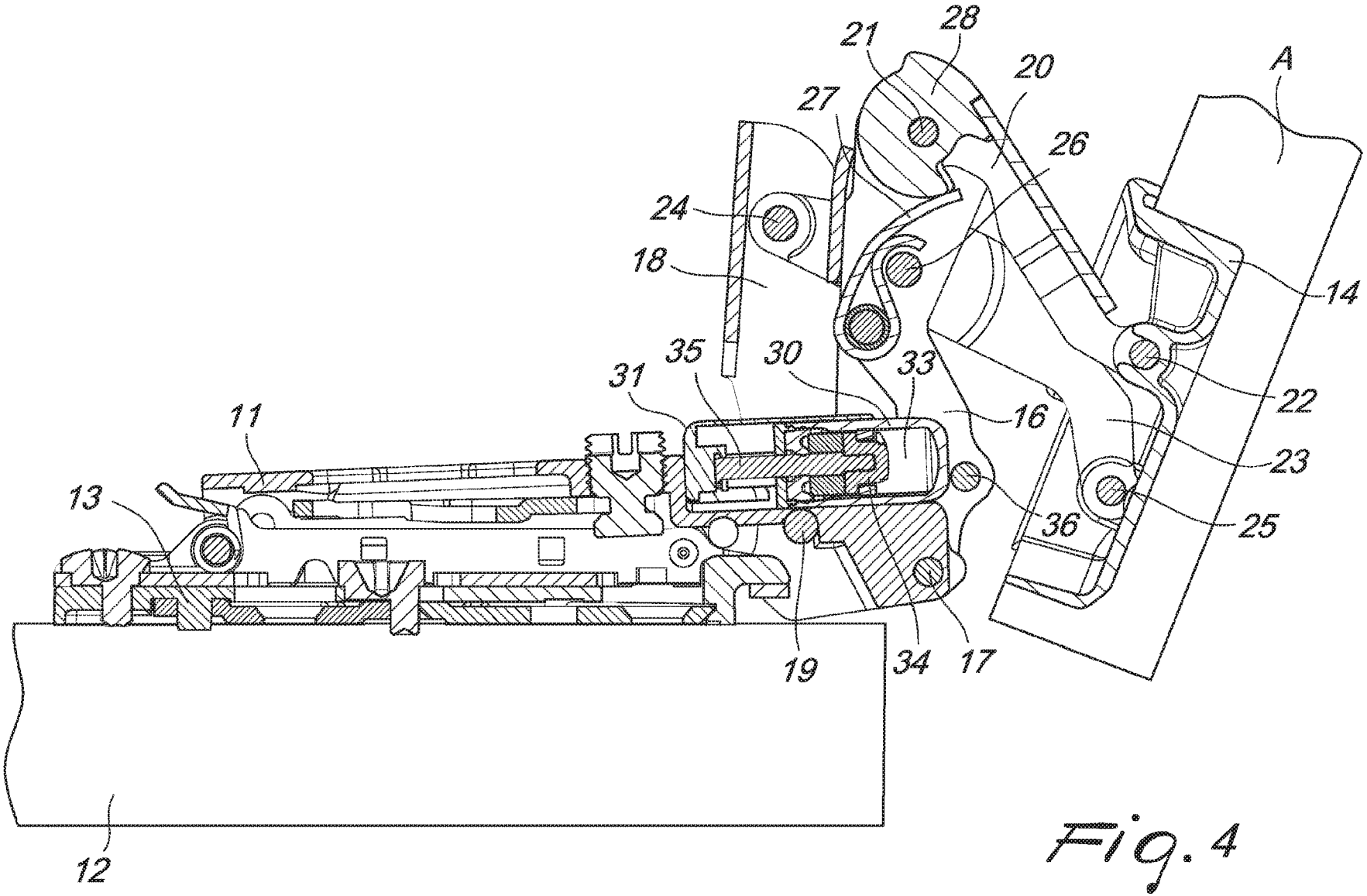
FIG. 4 is a longitudinal sectional view of the hinge of FIG. 1, at a closing angle of the hinge at which the damping device begins to perform its function.

FIGS. 1 to 6 show a hinge for mounting a door on a piece of furniture according to a first embodiment of the present invention, designated generally by the reference numeral 10; said hinge comprises a hinge arm 11 which can be fixed to a side wall 12 of the piece of furniture that forms a resting surface or to another fixed part of the piece of furniture by means of a conventional separate fixing base 13 which can be applied to said side wall 12 of the piece of furniture.

The arm 11 is provided with two side walls 11", which are substantially mutually parallel and spaced, and an intermediate wall 11' interposed between the sidewalls 11", which are extended along a longitudinal axis of said arm, preferentially forming a substantially C-shaped transverse cross-section.

The hinge 10 further comprises a hinge box 14 which can be fixed to a movable part of the piece of furniture, for example a door A, and is connected to the hinge arm 11 by means of an articulation system 15 which comprises a plurality of connecting levers which can move to allow the hinge to move between an open position and a closed position for the door A.

A reverse mounting of the hinge is not excluded in which the arm 11 is fixed to the door A or to another movable part of the piece of furniture and in which the box 14 is fixed to a fixed part or side wall 12 of the piece of furniture.

The articulation system 15 is of the type comprising four connecting levers and seven articulation axes, which allows to obtain wide opening angles of the doors, for example equal to or greater than 110°, as well as specific movements for the door, which are required for example to allow the opening of doors with particular shapes or made of glass or the like.

In particular, the articulation system 15 comprises a first connecting lever 16 which is articulated to a front end of the hinge arm 11 that is directed toward the door of the piece of furniture by means of a first axis 17, and comprises a second connecting lever 18 which is again articulated to a front end of the hinge arm 11 by means of a second axis 19 which is spaced from the preceding one in the direction of the rear end of said arm 11.

Preferentially, the ratio between the length of the hinge arm 11 and the distance between the first axis 17 and the second axis 19 is comprised for example between 4 and 8.

The first connecting lever 16, at the end that is opposite with respect to the first axis 17, is articulated to a third connecting lever 20 by means of a third axis 21 at a first end of said third lever; at the opposite end, the third lever 20 is articulated to the box 14 by means of a fourth axis 22 arranged at the front part of said box 14.

The second connecting lever 18, at the opposite end with respect to the second axis 19, is articulated to a fourth connecting lever 23 by means of a fifth axis 24 at a first end of said fourth lever; at the opposite end, the fourth lever 23 is articulated to the box 14 by means of a sixth axis 25 arranged at the rear part of said box 14.

Finally, the first connecting lever 16 and the fourth connecting lever 23 are mutually articulated in an intermediate point thereof by means of a seventh articulation axis 26.

The hinge 10 further comprises spring means which act in the closing direction of the hinge, which preferentially comprise a leaf spring 27 which is C-shaped and is mounted integrally with the first connecting lever 16, said spring 27 having an arm which cooperates and acts on a cam 28 which is integral with the third connecting lever 20.

The hinge further comprises a damping device 29 which is provided with an actuation member 30 which can move in a linear manner along a longitudinal axis.

According to the present invention, the damping device 29 is enclosed at least partially between the side walls 11" of the hinge arm 11; furthermore, the actuation member 30 of the damping device 29 is extended at a front end of the hinge arm 11 that is directed toward the hinge box 14 in order to make contact with a thrust element which is integral with one of the connecting levers 16, 18, 20, 23 of the articulation system 15 of the hinge or to the hinge box 14 at least in a range near the closure position of the hinge.

In the preferred embodiment shown in FIGS. 1 to 6, the damping device 29 is provided with a housing body 31 which is shaped so as to be arranged and fixed in a housing seat or cavity 32 that is provided at a front end of the hinge arm 11 and is enclosed between the side walls 11", in particular a cavity 32 which is provided in the intermediate wall 11' of the hinge arm 11 and is also open at the front end of said arm 11.

The longitudinal axis of the actuation member 30 and the longitudinal axis of the hinge arm 11 preferentially lie on a plane that is substantially perpendicular to the surface of the door A and to the fixing plane of said arm 11 and can be substantially mutually parallel or inclined, for example by an angle comprised between 1° and 20°.

The damping device 29 further comprises a damper preferentially of the fluid-operated linear type, for example using oil, air or grease, which in turn comprises a cylinder 30 which forms a chamber 33 for the fluid, in the specific case oil, in which a piston 34 provided with an annular sealing gasket can move slidingly.

In the illustrated embodiment, the actuation element 30 of the damping device and the cylinder of the damping device coincide or are in the case provided monolithically; however, it is not excluded that they might be configured as mutually connected separate parts.

The damper further comprises a rod 35 which is connected to the piston 34, said rod protruding from the cylinder through a hole in a lid on a rear side of said cylinder so as to be able to engage an appropriately provided retention seat provided in the housing body 31 at a rear end thereof. There is furthermore a spring for resetting the damper, which is arranged for example coaxially to the rod 35 between the rear lid of the cylinder and the housing body 31 or is arranged inside the cylinder 30 between the piston 34 and the front end of said cylinder 30.

As an alternative, the damper can be turned oppositely, with the cylinder directed toward the rear end of the arm 11 and with the rod 35 of the piston directed toward the front end in order to act as an actuation member or with a separate actuation member connected to said rod.

The housing body 31 preferentially has a hollow semi-cylindrical shape and, together with the seat 32 of the hinge arm 11, cooperates to form as a whole a sliding seat for the actuation member 30, which protrudes forward from the housing body 31 so as to make contact, as mentioned, with a thrust element which is integral with one of the connecting levers 16, 18, 20, 23 of the articulation system 15 of the hinge or with the box 14 of the hinge.

In the preferred embodiment of FIGS. 1 to 6, the thrust element is in the form of a cross pin 36 which is connected integrally to the first connecting lever 16 articulated to the front end of the arm 11; said pin 36, during the terminal part of the closing motion of the hinge, in which the box 14 performs for example an oscillation from an open position comprised between 15° and 30° up to the fully closed position of the hinge, makes contact with and acts on a front surface of the interaction element 30 so as to compress the damping device, thus achieving a slowing of the closing motion of said hinge.

As an alternative, the thrust element can be integral with another one of the connecting levers 16, 18, 20, 23 of the articulation system 15, for example the second lever 18, providing in this case an appropriate shape of said thrust element and/or of the actuation member of the damping device and/or of the articulation system as a whole.

Furthermore, it is not excluded that the thrust element, as an alternative to the pin, might be constituted by a part or element of the first connecting lever 16 itself, for example a transverse wall of the lever 16, or also by a cam or other element which is connected to said lever 16 and is appropriately shaped to provide in general a thrust surface capable of actuating the damper, for example shaped so as impart a specific rule of motion to the compression of said damper.

According to an alternative configuration, the actuation member can be extended between the side walls 11" of the arm 11 without protruding from the housing body 31, and the thrust element can be configured so as to protrude inside the front opening of the housing seat for the damping device so as to compress the damper.

As mentioned, as an alternative to the actuation of the damper by a thrust element that is integral with a lever of the articulation system, the damper can be actuated by a thrust element which is integral with the hinge box 14, for example by a part of said box or by a separate element that is connected integrally to said box.

Therefore, the actuation member can be actuatable directly or indirectly by one of the connecting levers of the hinge articulation system or by the hinge box.

Figure 5:
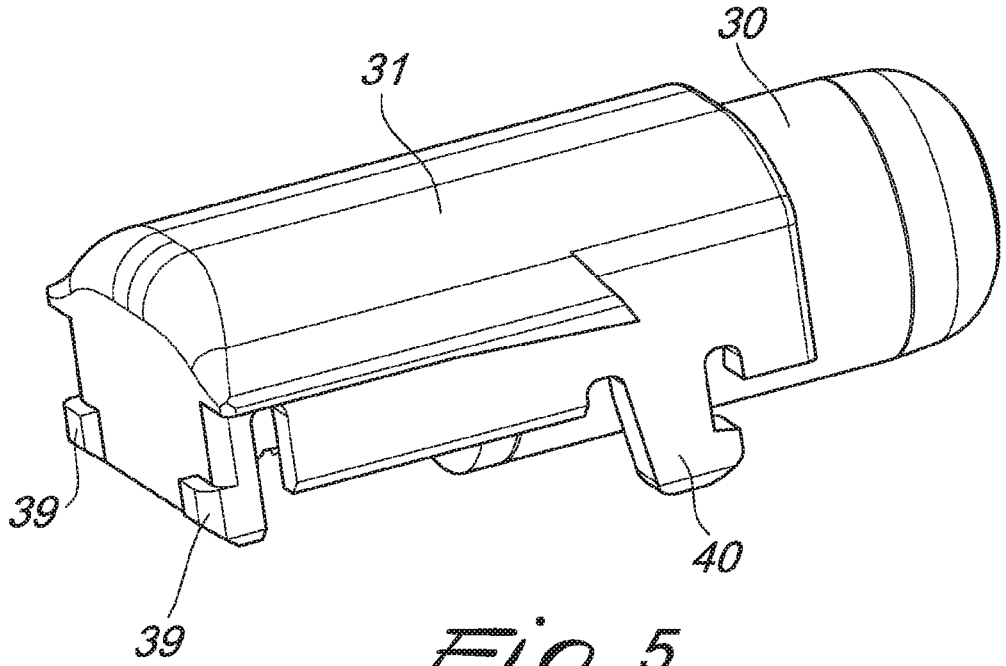
FIG. 5 is a perspective view of the damping device shown in FIG. 1, removed from the hinge arm.
Figure 6:
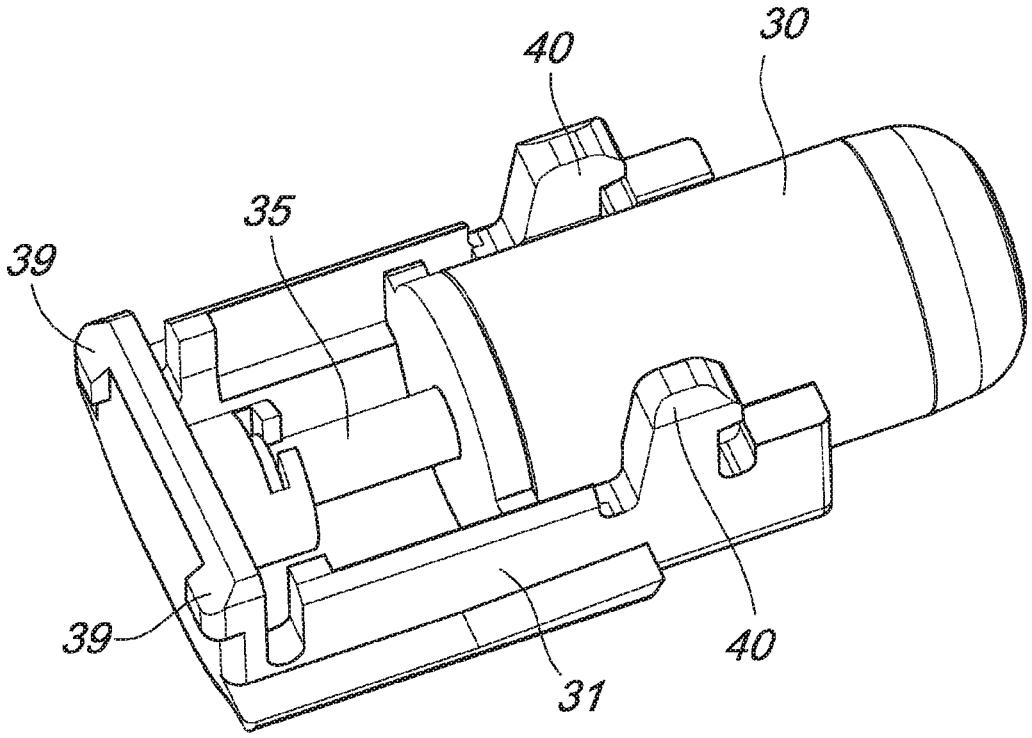
FIG. 6 is a view from below of the damping device of FIG. 5.

As shown more clearly in FIGS. 5 and 6, for the purpose of fixing the damping device 29 inside the seat 32 in the hinge arm 11, the housing body 31 preferentially has a plurality of elastic hooking elements, for example two rear elastic teeth 39 and two elastically flexible lateral hooks 40, which are shaped and arranged so as to hook by snap action in corresponding openings in the housing seat 32.

As an alternative, the housing body 31 can comprise quick fixing means of another type, for example rotatable and sliding locking means, bayonet couplings or the like, for fixing to the hinge arm 11.

In this manner it is possible to hook and unhook the damping device 29 with respect to the hinge arm 11 in a simple manner, allowing to adapt the braking effect that can be obtained on the doors as a function of the weight and dimensions of said doors.

In particular, since each door is supported so that it can oscillate by at least two hinges, it is possible to provide for the application of the damping device to all the hinges that are present, thus achieving a higher braking effect which is useful in particular in the case of heavy doors, or it is possible to provide for the application of the damping device only to some of the hinges provided for supporting the door, for example one hinge provided with a damping device and one hinge without the damping device, thus achieving a reduced braking effect, which is sufficient for lightweight doors.

If the damping device 29 is not applied, it is possible to provide for the application of a cover, not shown, to close the housing seat 32 in the hinge arm 11, said lid being fixable in a removable manner to said arm 11.

Figure 7:
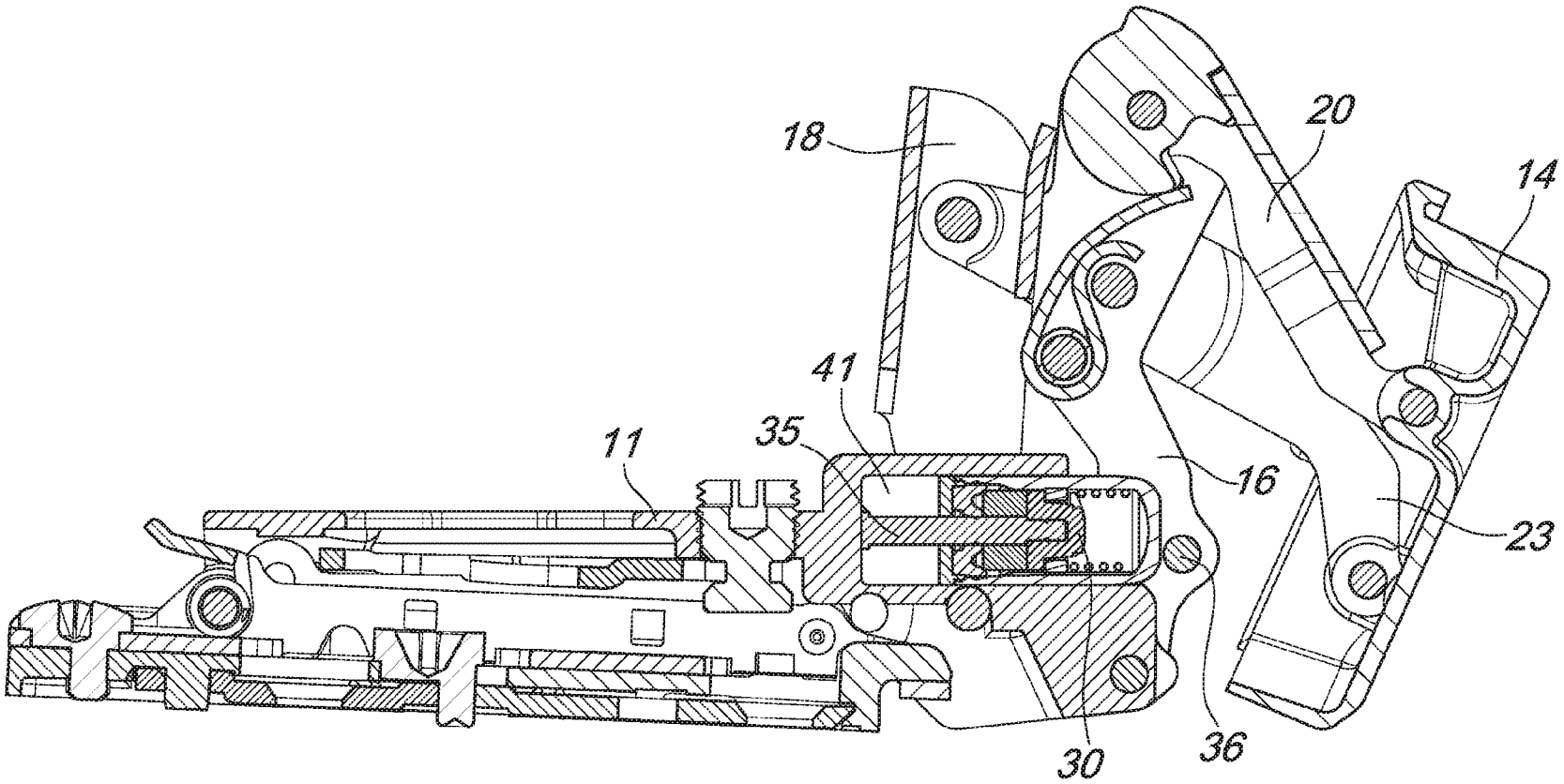
FIG. 7 is a longitudinal sectional view of a second embodiment of the hinge according to the invention with the damping device applied in the hinge arm.

FIG. 7 shows a second embodiment of the hinge according to the invention with the damping device applied in the hinge arm.

In particular, the hinge arm 11 is provided with a housing seat 41 that is open only at the front end of said arm 11 and in which the damping device is inserted axially.

In this case, the damping device may not comprise the housing body but only the fluid-operated linear damper.

Preferentially, the damper comprises a cylinder 30 which coincides with the actuation member and protrudes forward from the seat 41 to come into contact with a thrust element which is integral with one of the connecting levers 16, 18, 20, 23 of the articulation system 15 of the hinge or with the hinge box 14 at least in a range near the closure position of the hinge.

In this case, the intermediate wall 11' of the arm 11 has no opening for the insertion of the damping device, since the damper is inserted axially in the seat 41 from a front end of the arm 11.

In this embodiment also it is possible to provide all the variations described with reference to the first embodiment, with particular reference to the configuration and arrangement of the damper, of the actuation member and of the thrust element for the damping device.

In practice it has been found that the invention achieves the intended aim and objects, providing a damped hinge that has a damping device that has a simple actuation and entails limited modifications to the standard configuration of the hinges for the positioning of the damping device.

Furthermore, the damping device has a limited space occupation inside the piece of furniture and there are no additional elements on the door that entail hindrances to use.

The hinge according to the invention is susceptible of numerous modifications and variations, all of which are within the scope of the appended claims; the constructive details may furthermore be replaced with technically equivalent elements.

In practice, the materials used and the contingent shapes may be any according to the requirements and the state of the art.

The disclosures in Italian Patent Application No. 102018000004919 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. Hinge for mounting a door on a piece of furniture, comprising:

a hinge arm having a first and a second side walls, the hinge arm being fixable to a fixed part or to a door of the piece of furniture;

a box fixable to the door or to the fixed part of the piece of furniture and connected to the hinge arm by an articulation system comprising a plurality of movable connecting levers and seven articulation axes;

spring means acting in a closing direction of the hinge; and a damping device having an actuation member linearly movable according to a longitudinal axis, wherein said damping device is at least partially enclosed between said side walls of the hinge arm, wherein the hinge arm comprises a housing seat for said damping device, open at least at the front end of the same arm, the damping device being fitted in said housing seat, and wherein the actuation member of said damping device extends at a front end of the hinge arm facing the hinge box for contacting a thrust element of one of said movable connecting levers of the articulation system or integral with one of said movable connecting levers or with said hinge box at least in a range near a closing position of the hinge, in which said housing seat is conformed as a cavity made in an intermediate wall between said side walls of said hinge arm, wherein the damping device has a housing body conformed to be arranged, and wherein the damping device is configured to be removable from the housing seat.

2. The hinge according to claim 1, wherein the damping device comprises a damper of the fluid linear type, said damper comprising a cylinder defining a chamber for the fluid, in which a piston having a rod protruding from the same cylinder is slidably movable.

3. The hinge according to claim 2, wherein the actuation member of the damping device and the cylinder of the damper are integrally made with each other.

4. The hinge according to claim 2, wherein the actuation member of the damping device and the cylinder of the damper are configured as separate pieces connected with each other.

5. The hinge according to claim 2, wherein the actuation member of the damping device consists of the piston rod or of a separate member connected to the same rod.

6. The hinge according to claim 1, wherein the housing body has a semicylindrical hollow shape defining, together with the seat of the hinge arm, a sliding seating for the actuation member, said actuation member protruding frontally from the housing body for contacting said thrust element integral with one of said movable connecting levers of the articulation system or with the hinge box.

7. The hinge according to claim 1, wherein the thrust element is configured as a cross pin integrally connected with a first connecting lever of said movable connecting levers, articulated at the front end of the arm, said pin acting on a front surface of the actuation member during an end part of the hinge closing movement.

8. The hinge according to claim 1, wherein the thrust element consists of a part of a first connecting lever of said movable connecting levers or of a cam or shaped element connected with said first connecting lever.

9. The hinge according to claim 1, wherein the housing body has a plurality of elastic hooking elements conformed and arranged for snap hooking in corresponding openings in the housing seat in the hinge arm.

10. The hinge according to claim 9, wherein the damping device is removably hookable and unhookable to the hinge arm.

11. The hinge according to claim 1, wherein the hinge arm has a housing seat open only at a front end of said hinge arm.

12. Hinge for mounting a door on a piece of furniture or the like, comprising:

a hinge arm having a first and a second side walls, the hinge arm being fixable to a fixed part or to a door of the piece of furniture;

a box fixable to the door or to the fixed part of the piece of furniture and connected to the hinge arm by an articulation system comprising a plurality of movable connecting levers and seven articulation axes;

spring means acting in a closing direction of the hinge; and a damping device having an actuation member linearly movable according to a longitudinal axis, wherein said damping device is at least partially enclosed between said side walls of the hinge arm, wherein the actuation member of said damping device extends at a front end of the hinge arm facing the hinge box for contacting a thrust element of one of said movable connecting levers of the articulation system or integral with one of said movable connecting levers or with said hinge box at least in a range near a closing position of the hinge, wherein the hinge arm comprises a housing seat for said damping device, open at least at the front end of the same arm, the damping device being fitted in said housing seat, in which said housing seat is conformed as a cavity made in an intermediate wall between said side walls of said hinge arm, wherein the damping device has a housing body conformed to be arranged and fixed in said housing seat in a removable way, and wherein the housing body has a plurality of elastic hooking elements conformed and arranged for snap hooking in corresponding openings in the housing seat in the hinge arm.

* * * * *